US007066195B2

(12) United States Patent
Anguera Font

(10) Patent No.: US 7,066,195 B2
(45) Date of Patent: Jun. 27, 2006

(54) TWO-WAY TRAP

(76) Inventor: Juan Anguera Font, Buenos Aires, 28-5º 4ª, 08036 Barcelona (ES)

( * ) Notice: Subject to any disclaimer, the term of this patent is extended or adjusted under 35 U.S.C. 154(b) by 0 days.

(21) Appl. No.: 10/616,250

(22) Filed: Jul. 9, 2003

(65) Prior Publication Data

US 2004/0007263 A1 Jan. 15, 2004

(30) Foreign Application Priority Data

Jan. 9, 2001 (ES) ..... 200100112
Jan. 8, 2002 (ES) ..... PCT/ES02/00004

(51) Int. Cl.
*E03C 1/284* (2006.01)
*F16K 37/00* (2006.01)

(52) U.S. Cl. ..... 137/247.29; 137/247.51; 137/558

(58) Field of Classification Search ..... 137/247.29, 137/247.49, 247.51, 558; 340/620
See application file for complete search history.

(56) References Cited

U.S. PATENT DOCUMENTS 649,340 A * 5/1900 Nerlson ..... 137/247.29
659,481 A * 10/1900 Kesselring et al. .... 137/247.29
749,503 A * 1/1904 Tokheim ..... 137/247.29
1,356,530 A * 10/1920 Khun ..... 137/247.29
2,278,304 A 3/1942 Arnold et al.
2,910,997 A * 11/1959 Baumbach ..... 137/247.29
2,985,187 A * 5/1961 Hamilton ..... 137/558
3,766,575 A * 10/1973 Grengs ..... 137/247.49
4,796,658 A * 1/1989 Caple ..... 137/558
4,962,370 A 10/1990 Borriello
5,054,513 A * 10/1991 Trueb et al. ..... 137/247.51
6,423,213 B1 * 7/2002 Mazurek ..... 340/620

FOREIGN PATENT DOCUMENTS

GB 2146675 4/1985
JP 5118066 5/1993

* cited by examiner

*Primary Examiner*—John Rivell
(74) *Attorney, Agent, or Firm*—Polster, Lieder, Woodruff & Lucchesi L.C.

(57) ABSTRACT

This invention prevents blockage that occurs in the general drainage traps of buildings. The invention consists in connecting a conduit by positioning it in the inlet part above the trap water float level (M) and in the outlet part below a line (N) thereby forming a new auxiliary trap. The invention is suitable for use in traps in buildings which are connected to the common sewage system. The invention informs and thereby prevents the obstruction of the trap by the use of an alarm which is installed in the conduit wherein the water is diverted due to gravity when the conduit is obstructed and signals any obstruction in the conduit so that it can be cleared without waiting for the consequences of such a situation to occur. Also although water flows freely through the auxiliary trap section air does not freely communicate between the inlet and outlet pipes and foul odors are avoided.

13 Claims, 3 Drawing Sheets

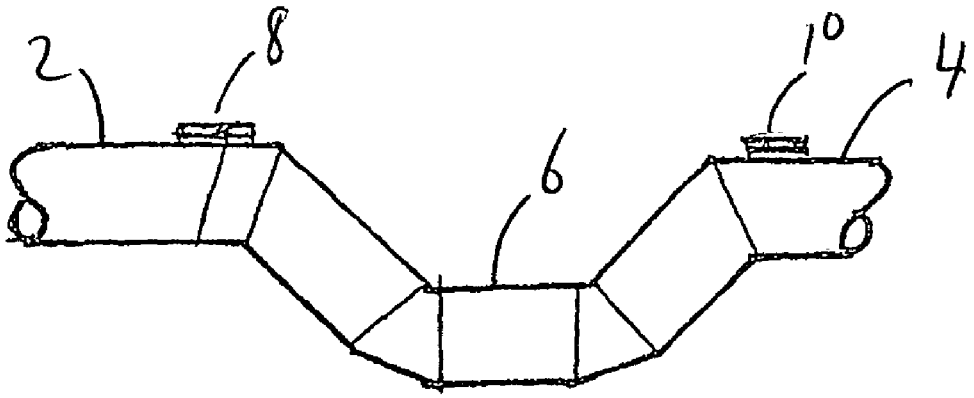
FIG. 1 - Prior Art
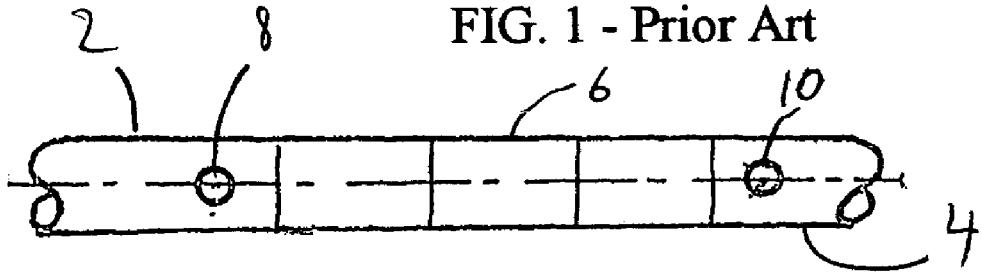
FIG. 2 - Prior Art
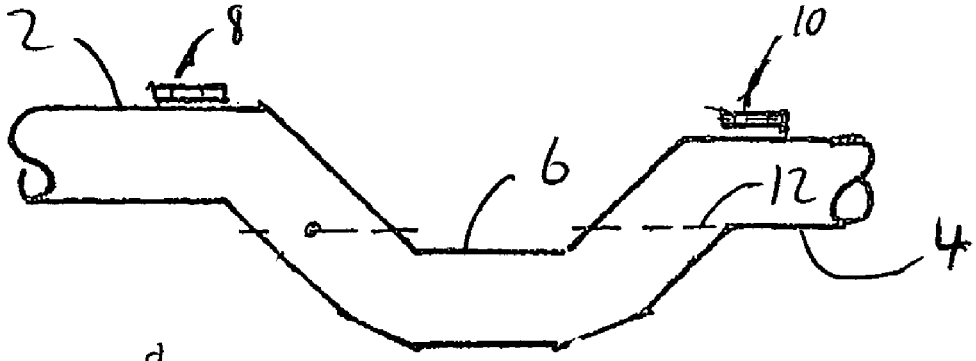
FIG. 3 - Prior Art
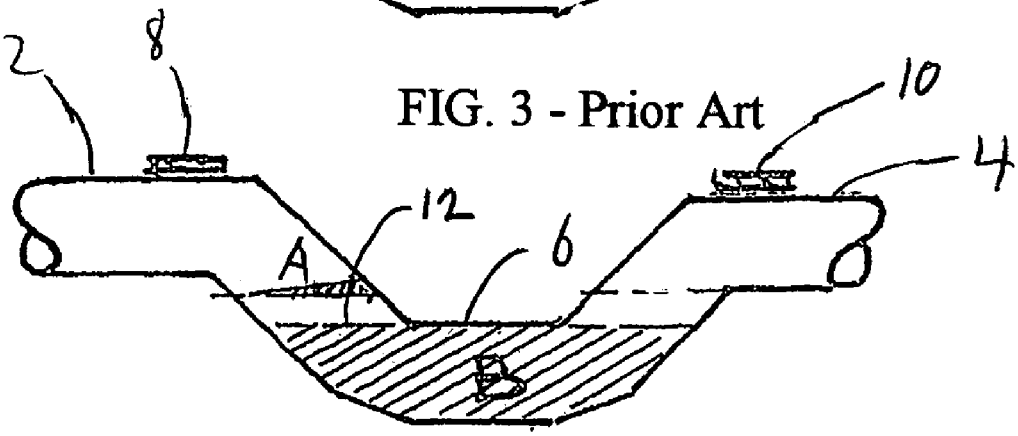
FIG. 4 - Prior Art

TWO-WAY TRAP

BACKGROUND OF THE INVENTION

This invention relates generally to drainage systems and particularly to drain traps in such systems.

The state-of-the-art known by the applicant refers to general drain traps in buildings. These are installed before the connection to the sewer network, to prevent effluences and foul odors from the sewer from spreading through the building drainage network to the interior of buildings and through the drains of terraces and patios. The problem posed in this case is that it is impossible to anticipate when blockage will occur, which is generally due to the discharge of solid materials or to accumulation of deposits that are not carried away by the water, or to solidification of detergent scum that accumulates in the general trap.

Referring to FIGS. 1–4, the prior art drainage system comprises an inlet pipe 2 and an outlet pipe 4. Disposed between the inlet pipe 2 and the outlet pipe 4 is a general trap section 6. Manholes 8, 10 are disposed within the inlet pipe 2 and outlet pipe 4 respectively. In use, the general trap section 6 fills with water to the level of line 12 and prevents the smell of sewage from passing from the outlet pipe 4 to the input pipe 2. Referring to FIG. 4, when the trap 6 becomes filled with a blockage A or a blockage B, the sewer becomes clogged and no water flows through the inlet pipe 2 to the outlet pipe 4. When the water level falls below that shown in FIG. 4, the trap fails to prevent the smell of sewage passing from the outlet pipe 4 to the inlet pipe 2.

SUMMARY OF THE INVENTION

The present invention provides a two-way trap comprising an inlet pipe and an outlet pipe. A general trap section is attached to and disposed between the inlet pipe and outlet pipe such that when filled with water to an equilibrium water level equal to the lowest point of the outlet pipe, air does not freely communicate between the inlet pipe and the outlet pipe. An auxiliary trap section is attached to either the inlet pipe or trap section at a point above the equilibrium water level at a first end and attached to the trap section at a point below the equilibrium water level at a second end, such that if the general trap section became blocked water would flow through the auxiliary trap section yet air would not freely communicate between the inlet pipe and the outlet pipe.

DESCRIPTION OF THE DRAWINGS

FIG. 1 is a side elevational view of a prior art trap;

FIG. 2 is a top plan view of said prior art trap;

FIG. 3 is a side elevational section view of said prior art trap showing the water level therein;

FIG. 4 is a side elevational section view of said prior art trap showing blockages therein;

DETAILED DESCRIPTION OF THE PREFERRED EMBODIMENT

Figure 5:
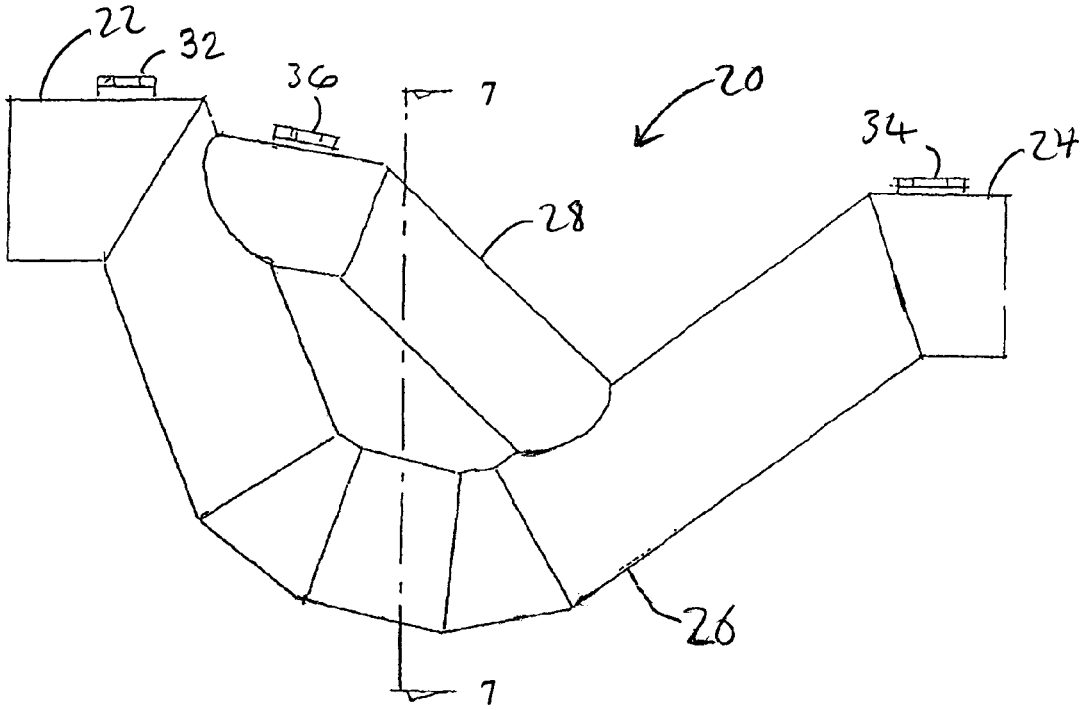
FIG. 5 is a side elevational view of an improved two-way trap according to an embodiment of the present invention.

While the invention is susceptible of embodiment in many different forms, there is described in detail preferred embodiments of the invention. It is to be understood that the present disclosure is to be considered only as an example of the principles of the invention. This disclosure is not intended to limit the broad aspect of the invention to the illustrated embodiments. The scope of protection should only be limited by the claims.

The invention consists of the possibility of preventing and therefore providing a solution for blockages that occur in general building traps, thus precluding the difficulties and troubles resulting from this type of obstruction, which basically involves water from the sewer backing up until it runs out through the drains of ground floors, patios, terraces and plumbing fixtures, producing a strong stench and in many cases causing the building's main sewer to break, as it is not prepared to support the weight of so much water. All this means that, in most cases, ground floors and basements are flooded with, we repeat, a strong stench.

After streamlining the general trap in a more functional way, the invention basically consists of connecting to this general trap a new smaller diameter pipe, so that it connects the water inlet part above the waterline within elevation (M) (FIG. 8) to the outlet part at the opposite end of the trap but below the waterline at an elevation (N), thus forming a new two-way drain trap that fulfills the previous functions, i.e. preventing foul odors and effluents from the sewer.

This new pipe or auxiliary trap will only start working (by virtue of the position of its connections) when the general trap is totally or partially obstructed. In these cases, the water, by the effect of gravity, will be detoured to this new by-pass pipe without interrupting the building's drainage function and thus avoiding the consequences described above. It is also possible to connect an optic or acoustic 37 alarm that indicates when water is flowing through the auxiliary pipe, which will be a warning that the general trap must be cleaned because it is blocked to a greater or lesser extent. Nevertheless, if this latter circumstance should occur, and in spite of the blockage, the trap would continue to work up until the moment when the auxiliary pipe or trap is closed off.

Manually constructing the two-way trap by using PVC pressure pipe, in straight or bent sections and cut to the desired size and shape, forming the openings and coupling them to each other, and welding these joints with a hot air jet and virgin PVC rod, which provides good watertightness and resistance (the use of bent or special pieces is usually prohibitive because of the high cost for large diameters). All measurements, diameters, connection points and angle irons shall be variable, to adapt to the siting needs of each building, thus allowing for serial and more customized fabrication.

The purpose of the invention is to prevent the collapse of a building's drainage networks as a result of obstruction of the general trap. It involves functionally streamlining the trap by providing it with a new drainage channel in order to prevent these collapses and the serious consequences resulting from them.

This new pipe or two-way trap is characterized by the fact that it only starts working when the general trap is obstructed, as it has a new auxiliary trap that acts as a spillway or overflow channel for the main sewer since the water is detoured by gravity to the end section or outlet of the trap, away from the blocked zone, and that this circumstance can be taken advantage of to install an optic or acoustic alarm system in this pipe that indicates when this new channel starts working, which will be a warning that a total or partial obstruction of the general trap has occurred.

Figure 6:
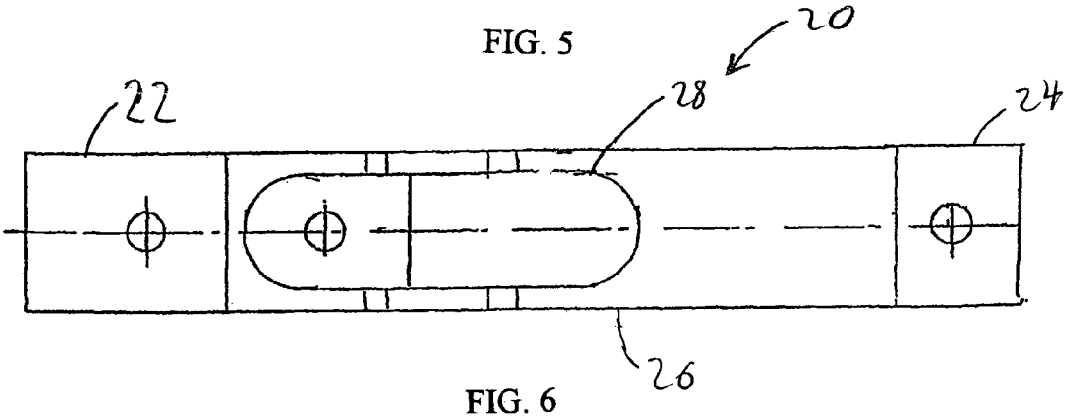
FIG. 6 is a top plan view of the two-way trap of FIG. 5.
Figure 7:
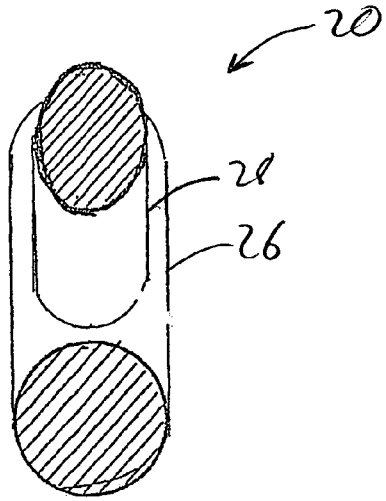
FIG. 7 is a cross section view of the two way trap of FIG. 5 taken along line 7—7 of FIG. 5.
Figure 8:
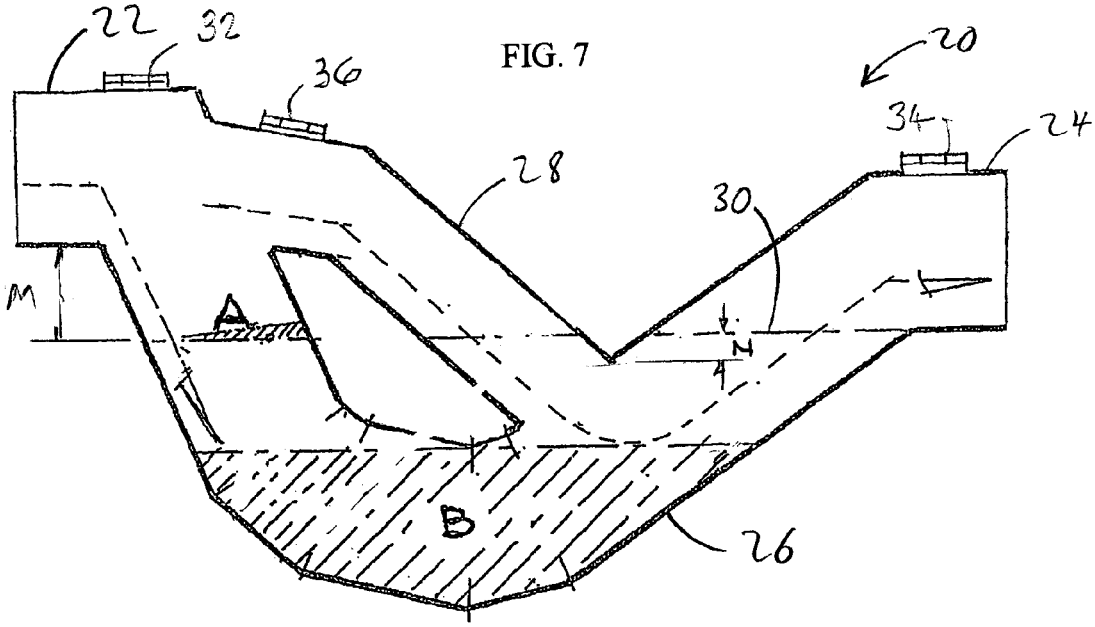
FIG. 8 is a side elevational section view of the two-way trap of FIG. 5.

FIGS. 5 and 6 show an elevation and plan drawing with the coupling of the two-way pipe, although it is in FIG. 8 where its operation can best be appreciated. When the trap by blockage in zone A (solidified scum) or in zone B (solid elements that are not carried away) becomes totally or partially obstructed, the water will flow upward by gravity until it reaches the two-way trap located at a distance (M), and it will flow out at the opposite end of the trap at a distance (N) from the waterline, as indicated by the dashed line for the water route. At its outlet, through the effect of turbulences that can occur at this point, especially on rainy days when there is a larger makeup flow, it can help to clear the obstruction by removing the solid parts that are not compacted.

FIGS. 5–8 show the structural arrangement of parts of a combination drain trap 20 according to the present invention. The drain trap 20 comprises an inlet pipe 22, an outlet pipe 24 and a trap section 26 disposed therebetween. When water is flowing from the inlet pipe 22 to the outlet pipe 24 through the trap section 26, the water level raises to a line 30, the low level of the outlet pipe 24. The water level is such that air will not flow from the outlet pipe 24 to the inlet pipe 22 through the trap section 26, or vice versa. Furthermore, the drain trap 20 further comprises a secondary or auxiliary trap 28 connected at a first end to either the inlet pipe 22 or the general trap section 26 at a location or a point above the line 30 and at a second end to the general trap section 26 at a point below the line 30. In this manner, when the general trap section 26 is not blocked by a blockage, water flows through the trap section 26 and the water level is such that air will not flow between the inlet pipe 22 and the outlet pipe 24, or vice versa, through the trap section 26 or the auxiliary trap 28. When a blockage A or B occurs in the trap section 26, water flows from the inlet pipe 22 through the secondary or auxiliary trap 28 around the blockage to the outlet pipe 24. When this occurs, the water level remains at line 30 and air will not flow between the inlet pipe 22 and the outlet pipe 24 due to the auxiliary trap 28 connecting to the trap section below the water line 30. In this way, the foul odors and effluents are avoided. In the embodiment shown, access manholes 32 and 34 are provided in the inlet pipe 22 and outlet pipe 24. In addition, a manhole 36 is provided in the auxiliary trap 28 for improved blockage access.

While the specific embodiments have been described, numerous modifications come to mind without significantly departing from the spirit of the invention, and the scope of protection should only be limited by the scope of the accompanying claims.

I claim:

1. A two-way trap comprising:

an inlet pipe;

an outlet pipe;

a general trap section attached to and disposed between the inlet pipe and outlet pipe such that when filled with water to an equilibrium water level equal to the lowest point of the outlet pipe, air does not freely communicate between the inlet pipe and the outlet pipe; and an auxiliary trap section attached to one of said inlet pipe and general trap section at a point above the equilibrium water level at a first end and attached to the general trap section at a point above a bottom of the general trap below the equilibrium water level at a second end, such that if the general trap section became blocked water would flow through the auxiliary trap section yet air would not freely communicate between the inlet pipe and the outlet pipe.

2. The two-way trap of claim 1, wherein the trap comprises an alarm for indicating when the water is flowing through the auxiliary trap section because the general trap section is blocked.

3. The two-way trap of claim 1, wherein the two-way trap further includes a manhole to provide access for repair.

4. The two-way trap of claim 1, wherein the auxiliary trap is in vertical alignment with the general trap.

5. The two-way trap of claim 1, wherein the auxiliary trap is offset to one side of the general trap.

6. In an improved drainage system:

an inlet pipe, an outlet pipe and a general trap disposed between said inlet and outlet pipes, said general trap providing that when filled with water to an equilibrium water level equal to the lowest point of the outlet pipe, air does not freely communicate between the inlet pipe and the outlet pipe, the improvement comprising an auxiliary trap disposed between the inlet pipe and the outlet pipe and having an inlet end operatively attached to the inlet pipe at or above the equilibrium level and an outlet end operatively attached to the outlet pipe below the equilibrium water level, at a location above a bottom of the trap such that if the general trap became blocked, water would flow through the auxiliary trap yet air would not freely communicate between the inlet pipe and the outlet pipe.

7. The improved drainage system of claim 6, wherein:

the auxiliary trap includes a manhole to provide access for repair.

8. The two-way trap of claim 6, wherein the trap comprises an alarm for indicating when the water is flowing through the auxiliary trap section because the general trap section is blocked.

9. The improved drainage system of claim 6, wherein:

the diameter of the auxiliary trap is smaller than the diameter of the general trap.

10. The improved drainage system of claim 6, wherein:

the general trap and the auxiliary trap are formed from straight plastic pipe.

11. Drain trap structure for installation in buildings, comprising:

an inlet section and an outlet section, the inlet section being disposed in a first predetermined level above the overflow water level defined by the level of the outlet section, and further comprising a trap interconnecting said inlet and outlet sections and having a descending portion connected to the inlet section and an ascending portion connected to the outlet section, the improvement comprising a duct that is branched off the inlet section at or above said first predetermined level and is connected to the ascending portion of the trap at a location above a bottom of the trap so that the uppermost edge portion of the entrance opening of said duct into the ascending portion is disposed in a predetermined level distance below the overflow water level.

12. The drain trap structure of claim 11 wherein said duct has a diameter which is smaller than that of said trap.

13. The drain trap structure of claim 11 wherein an alarm is connected to said duct.

* * * * *